United States Patent [19]

Aoki et al.

[11] Patent Number: 4,920,615

[45] Date of Patent: May 1, 1990

[54] SLIDE FASTENER SLIDER WITH DETACHABLE PULL TAB

[75] Inventors: Tsunetaka Aoki, Toyamaken; Susumu Ishii, Kurobe, both of Japan

[73] Assignee: Yoshida Kogyo K. K., Tokyo, Japan

[21] Appl. No.: 336,115

[22] Filed: Apr. 11, 1989

[30] Foreign Application Priority Data

Apr. 20, 1988 [JP] Japan ..... 63-53305[U]

[51] Int. Cl.[5] ..... A44B 19/26

[52] U.S. Cl. ..... 24/429; 24/419; 24/236

[58] Field of Search ..... 24/429, 419, 430, 236; 294/3.6

[56] References Cited

U.S. PATENT DOCUMENTS

| | | | |
|---|---|---|---|
| 585,085 | 6/1897 | Covert | 24/236 |
| 622,770 | 4/1899 | Jones | 24/236 |
| 644,183 | 2/1900 | Morse | 24/236 |
| 691,185 | 1/1902 | Schleicher | 24/236 |
| 751,915 | 2/1904 | Hooper | 24/236 |
| 820,703 | 5/1906 | Covert | 24/236 |
| 1,040,415 | 10/1912 | Reynolds | 24/236 |
| 1,691,111 | 11/1928 | Glaser | 24/236 |
| 3,991,447 | 11/1976 | Akashi | 24/430 |
| 4,570,309 | 2/1986 | Ishii | 24/429 |
| 4,768,263 | 9/1988 | Fukuroi et al. | 24/419 |

FOREIGN PATENT DOCUMENTS

| | | | |
|---|---|---|---|
| 0170466 | 2/1952 | Fed. Rep. of Germany | 24/429 |

*Primary Examiner*—Victor N. Sakran

*Attorney, Agent, or Firm*—Hill, Van Santen, Steadman & Simpson

[57] ABSTRACT

A slide fastener slider comprises a slider body, a pull tab support pivotally connected at one end to the slider body, and a pull tab removably attached to the opposite end of the pull tab support. The pull tab support comprises a hook portion hooked to define therein a gap for loosely receiving an annular portion of the pull tab and having in its inner surface engaging means; and a substantially U-shaped resilient member having at its opposite ends fitting means for fitting engagement with the engaging means, to thus close the gap.

9 Claims, 4 Drawing Sheets

SLIDE FASTENER SLIDER WITH DETACHABLE PULL TAB

BACKGROUND OF THE INVENTION

1. Field of the Invention

The present invention generally relates to slide fasteners, and more particularly to a slide fastener slider with a detachable pull tab.

2. Description of the Related Art

There are known in this field slide fastener sliders of the type comprising a slider body, a pull tab support pivotally connected at one end to the slider body and a pull tab removably attached to the opposite end of the pull tab support.

One typical slider of this type is disclosed in Japanese Laid-open Patent Publication No. 58-163302 and is shown once again here in FIG. 8 of the accompanying drawings for convenience. This conventional slider comprises a slider body (not shown), a pull tab support U pivotally connected at one end to the slider body and a pull tab T removably attached to the opposite end of the pull tab support U, the pull tab support U comprising an aperture V formed at said opposite end, a support portion W partly defining the aperture V, a channel S formed adjacent to said opposite end in communication with the aperture V, through which channel S the neck portion of the pull tab T is permitted to pass into the aperture V, and a resilient member or a two-leggd wire spring Z provided adjacent to the channel S and normally urged under its own resiliency to move in the direction to close off the channel S so that the pull tab T can be detachably attached to the pull tab support U.

This conventional slide fastener slider is advantageous in that it can be made of fewer parts, thus enabling the automatic assemblage thereof to some extent. Nevertheless, there still remain various drawbacks. In attaching the spring Z to the pull tab support U, the bent ends of the unaligned legs of the minute spring Z must be pivotally fitted in the respective tiny holes which are formed in the pull tab support U and positioned out of registry. Such delicate operation causes the automatic assemblage of the slider as a whole very tedious and time-consuming, resulting in decrease of production efficiency. Futhermore, since the spring Z is complicated in construction, and hence the pull tab support U which the spring is attached to is similarly complicated in construction, the dies used for molding these parts are complicated and expensive. Besides, since the dies are complicated, there would be much likelihood of defective parts or parts lacking in desired strength being produced, and molding methods available to production of these parts are limited to a die casting.

SUMMARY OF THE INVENTION

With the foregoing drawbacks in view, it is an object of this invention to provide a slide fastener slider wherein a support body and a resilient member constituting a pull tab support are simple in construction, so that the resilient member can be removably attached to the support body very easily and reliably, thus increasing the efficiency of assemblage of the slider as a whole and rendering the slider less costly.

According to the present invention, there is provided a slide fastener slider comprising a slider body, a pull tab support pivotally connected at one end to the slider body, and a pull tab removably attached to the opposite end of the pull tab support, said pull tab support comprising: a support body including a peripheral wall defining therein an aperture for the pivotal connection to the slider body, a beam linking the confronting ends of the peripheral wall and a hook portion including an upper wall extending from the confronting ends and a lower wall hooked therefrom to define with the upper wall a gap for loosely receiving an annular portion of the pull tab, said upper wall being raised above the level of the peripheral wall to thus define an opening between the proximal end of the upper wall and the beam, the upper wall and the lower wall having in their respective inner surfaces upper engaging means and lower engaging means; and a substantially U-shaped resilient member including an upper leg, a lower leg and an arcuate joint joining the upper and lower legs, the upper leg and the lower leg having at their respective distal ends upper fitting means and lower fitting means; the resilient member having its upper and lower fitting means brought into fitting engagement with the upper and lower engaging means, respectively, of the upper and lower wall, with its upper leg fitted through the opening and with its arcuate joint embracing the beam, so that the resilient member comes into reliable engagement with the support body to thus close the gap. The above and other objects, features and advantages of the present invention will become apparent to those skilled in the art from the following detailed description made with reference to the accompanying drawings in which preferred embodiments incorporating the principles of the present invention are shown by way of example only.

DETAILED DESCRIPTION

Figure 5:
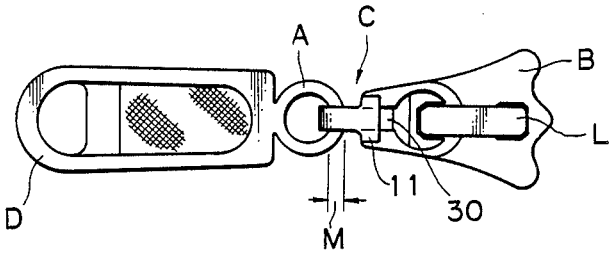
FIG. 5 is a schematic plan view of the slide fastener slider.

Referring now to the drawings and FIG. 5 in particular, there is shown a slider for slide fasteners according to a first embodiment of the present invention. The slider is shown to generally comprise a slider body B having a protuberant lug L projecting on its upper surface, a pull tab support C pivotally connected at one end to the lug L and a pull tab D removably attached to the opposite end of the pull tab support C.

Figure 1:
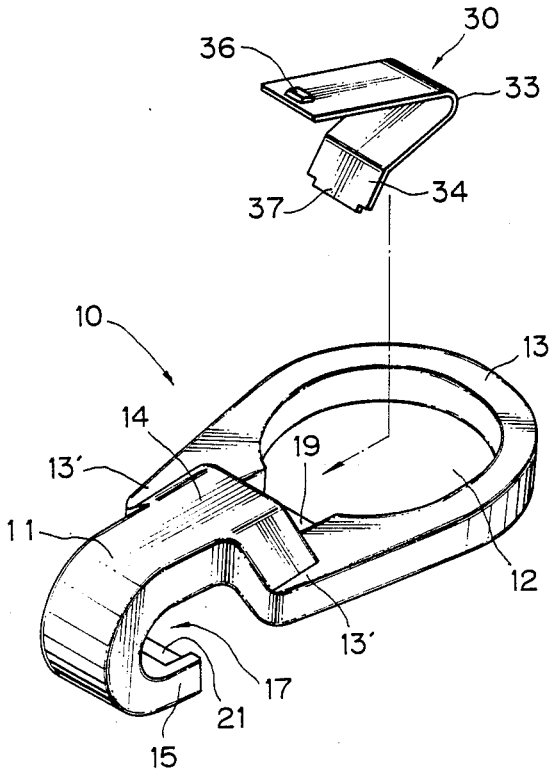
FIG. 1 an exploded perspective view of a pull tab support of a slide fastener slider according to the present invention.

As better shown in FIG. 1, the pull tab support C broadly comprises a support body 10 and a resilient member 30 adapted to engage with the support body 10 in the manner discussed more fully hereinafter.

The support body 10 generally includes an arcuate peripheral wall 13 defining therein an aperture 12 through which the protuberant lug L of the slider body B is loosely fitted for the pivotal connection of the pull tab support C to the slider body B, a beam 19 linking the confronting ends 13', 13' of the arcuate peripheral wall 13 and a hook portion 11 formed contiguous to the confronting ends 13', 13' of the peripheral wall 13. As better seen in FIGS. 1 and 2, the hook portion 11 has an upper wall 14 extending integrally from the confronting ends 13', 13' of the arcuate peripheral wall 13 and a lower wall 15 hooked downwardly and rearwardly therefrom so as to define with the upper wall 14 a gap 17 for loosely receiving the annular portion A of the pull tab D (FIG. 3). The upper wall 14 is raised above the level of the peripheral wall 13 to define an opening 18 between the proximal end 16 of the upper wall 14 and the beam 19, as better shown in FIG. 2. In addition, the beam 19 is formed at an upper side and a lower side with an upper furrow 22 and a lower furrow 23, respectively. The upper furrow 22 communicates with and is substantially of the same width as the opening 18. As better shown in FIG. 2, the hook portion 11 has, in the inner surface of the upper wall 14 and in the inner surface of the distal end of the lower wall 15, an upper groove 20 and a lower groove 21, respectively, for fitting engagement with an upper finger 36 and a lower finger 37, respectively, of the resilient member 30, as will be discussed more fully hereinafter.

Figure 2:
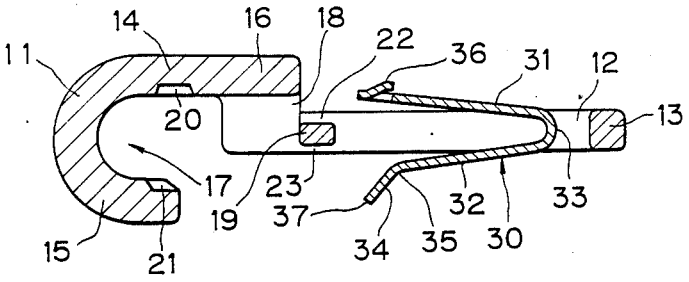
FIG. 2 is a longitudinal cross-sectional view of the pull tab support shown in FIG. 1.
Figure 3:
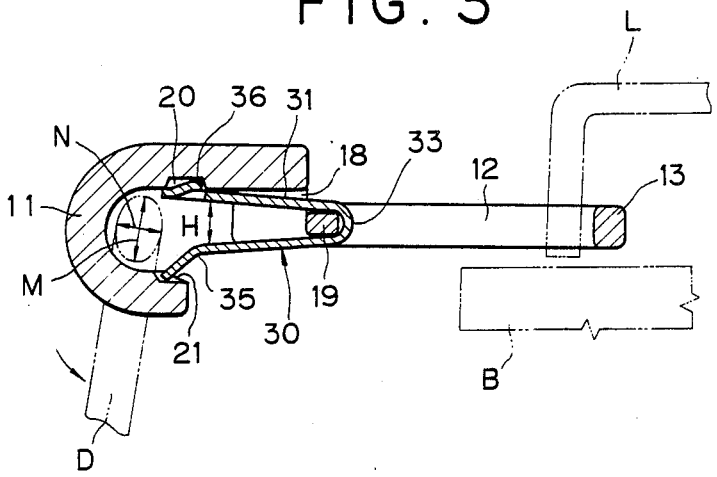
FIG. 3 is a longitudinal cross-sectional view of the pull tab support having a pull tab and a slider body connected thereto.
Figure 4:
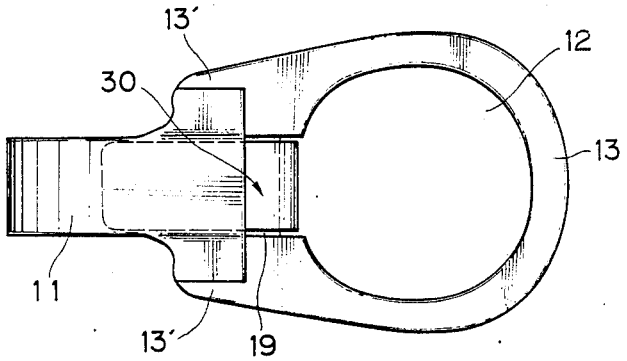
FIG. 4 is a plan view of the pull tab support.

As better shown in FIGS. 2 and 3, the resilient member 30 is a plate spring of substantially of U-shape and comprises an upper leg 31, a lower leg 32 and an arcuate joint 33 joining the upper and lower legs 31, 32. The upper leg 31 and the lower leg 32 are substantially as wide as the opening 18 (hence the upper furrow 22 as well) and the lower furrow 23, respectively. Advantageously, this assuredly prevents the upper leg 31 and the lower leg 32 from laterally jolting, when the upper leg 31 and the lower leg 32 of the resilient member 30 are fitted through the opening 18, the upper furrow 22 and the lower furrow 23. The upper leg 31 is provided at its distal end with an upper finger 36. The lower leg 32 is bent outwardly at 35 adjacent to the distal end thereof to provide a slant foot 34 extending obliquely downwardly therefrom. Such bending of the lower leg 32 provides increased resiliency thereto, so that the resilient member 30 can be attached to the support body 10 more retentively and reliably. The lower leg 32 is provided at its distal end with a lower finger 37. When the resilient member 30 is attached to the hook portion 11, as will be discussed more fully hereinafter; the upper finger 36 and the lower finger 37 are brought into fitting engagement with the upper groove 20 and the lower groove 21, respectively. Furthermore, the arcuate joint 33 of the U-shaped resilient member 30 comes into embracing engagement with the beam 19 of the hook portion 11 to thus function to place the resilient member 30 into the right position relative to the hook portion 11 in assemblage and to hold the resilient member 30 in situ.

Now, the method of attaching the pull tab D to the slider body B by means of the pull tab support C whose construction has been set forth closely above will be described below in conjunction with FIGS. 2 and 3.

First, the pull tab support C is attached to the protuberant lug L on the upper surface of the slider body B with the lug L loosely received in the aperture 12 of the support body 10. Then, the resilient member 30, while compressed against its resiliency, is inserted from the aperture 12 towards the gap 17, with the resilient member 30 riding astride the beam 19, until the arcuate joint 33 of the resilient member 30 comes into embracing engagement with the beam 19 of the support body 10. At this moment, the resilient member 30 is released and thus springs back under its own resiliency, whereupon the upper finger 36 and the lower finger 37 of the resilient member 30 are brought into fitting engagement with the upper groove 20 and the lower groove 21, respectively, of the hook portion 11.

Then, the annular portion A of the pull tab D is placed against the slant foot 34 of the resilient member 30 and thrust toward the gap 17, thereby lifting the lower finger 37 of the resilient member 30 out of the engagement with the lower groove 21 of the lower wall 15 against the resiliency of the resilient member 30, thus leaving an ample space between the lower finger 37 and the lower groove 21, through which space the annular portion A of the pull tab D is allowed to pass into the gap 17. Thereafter, the resilient member 30 springs back into the original disposition under its own resiliency, whereupon the lower finger 37 of the resilient member 30 comes back into fitting engagement with the lower groove 21 of the hook portion 11. As a result, the resilient member 30 comes into engagement with the hook portion 11 of the support body 10 to close the gap 17, so that the pull tab D has been attached to the slider body B by means of the pull tab support C.

There is an alternative method of attaching the pull tab D to the slider body B by means of the pull tab support C. First, the pull tab support C is attached to the lug L of the slider body B just as explained with the above-mentioned method. Then, as indicated in FIG. 3, the annular portion A of the pull tab D is loosely received in the gap 17 of the hook portion 11 beforehand. Subsequently, the resilient member 30 is brought into engagement with the support body 10 in the same manner as closely discussed with the above-mentioned method.

There sometimes arises a need to release the pull tab D from the pull tab support C such as for laundry. In such an event, the lower leg 32 of the resilient member 30 is lifted as by fingers against the resiliency of the resilient member 30 to thereby bring the lower finger 37 out of engagement with the lower groove 21 of the lower wall 15, thus leaving an ample space between the lower finger 37 and the lower groove 21, through which space the annular portion A of the pull tab D is allowed to come out of the hook portion 11.

As mentioned above, the pull tab D can be attached to and released from the pull tab support C and hence from the slider body B at the maximum ease.

It is to be noted that, when the resilient member 30 is attached to the hook portion 11 as shown in FIG. 3, the distance H between the bending point 35 of the lower leg 32 and the corresponding point of the upper leg 31 is less than the length M of the major axis and the length N of the minor axis of the oval cross-section of the annular portion A of the pull tab D. With this arrangement, the annular portion A of the pull tab D is fully exempt from getting stuck into the space between the upper leg 31 and the lower leg 32 of the resilient member 30, and hence the pull tab D is wholly prevented against jamming into the resilient member 30.

Figure 6:
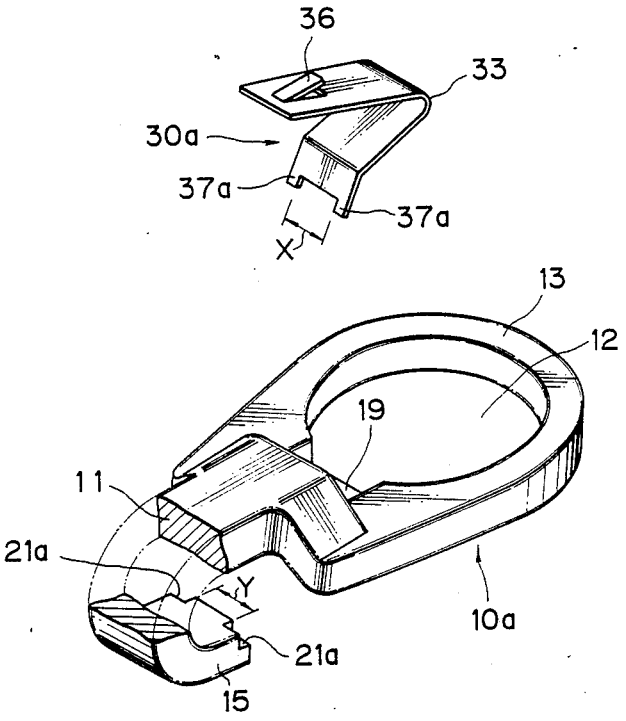
FIG. 6 is an exploded perspective view, partly cutaway, of a pull tab support of a slide fastener slider according to another embodiment.

FIG. 6 shows a modification according to the present invention in which, instead of a single lower groove 21, a pair of corner notches **21*a*, 21*a* as engaging means are formed in both corners of the inner surface of the lower wall 15, while a pair of corresponding fingers 37***a*, 37*a* are provided at both corners of the lower leg 32 of the resilient member 30*a* for fitting engagement with the notches 21*a*, 21*a*. The distance X between both fingers 37*a* and 37*a* is slightly greater than the distance Y between both corner notches 21*a* and 21*a*. With such arrangement, when the fingers 37*a*, 37*a* of the resilient member 30*a* come into fitting engagement with the corner notches 21*a*, 21*a* of the hook portion 11, the resilient member 30*a* is well prevented from accidental lateral jolting relative to the hook portion 11. Besides, in lieu of the finger 36 of small width, an engaging piece of greater width may be used.

Figure 7:
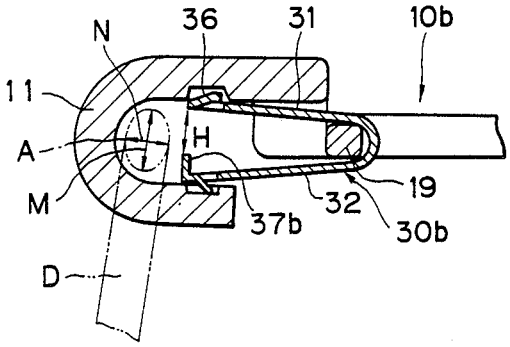
FIG. 7 is a fragmentary longitudinal cross-sectional view of a slide fastener slider according to still another embodiment.
Figure 8:
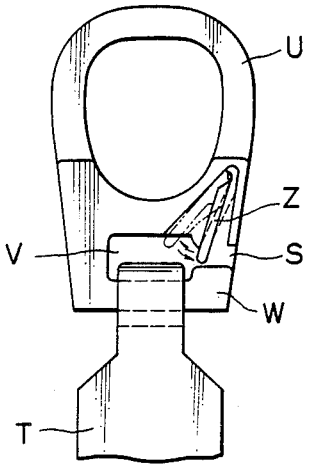
FIG. 8 RELATED ART
FIG. 8 is a fragmentary plan view of a portion of a slide fastener slider according to a related art.

FIG. 7 shows still another embodiment wherein the lower leg 32 of the resilient member 30*b* is made of a straight plane void of any bend but, instead, is provided at its distal end with an upright stopper 37*b*. The distance H between the top of the upright stopper 37*b* and the distal end of the upper leg 31 is less than the length of the major axis M and the length of the minor axis N of the oval cross-section of the annular portion A of the pull tab D, so that the annular portion A is assuredly prevented from getting stuck fast in between the upper leg 31 and the lower leg 32 of the resilient member 30*b*.

With the arrangement of the present invention, there are enjoyed various advantages. The pull tab support and the resilient member are very simple in construction. Since the attachment of the resilient member to the support body can be accomplished easily and reliably by unidirectional insertion of the former into the latter, the automatic assemblage of the slider as a whole can be effected quickly and efficiently. Besides, the pull tab can be attached to and detached from the pull tab support and hence the slider body easily by just compressing the resilient member.

Obviously, many modifications and variations of the present invention are possible in the light of the above teachings. It is therefore to be understood that within the scope of the appended claims, the invention may be practiced otherwise than as specifically described.

What is claimed is:

1. A slide fastener slider comprising a slider body, a pull tab support pivotally connected at one end to the slider body, and a pull tab removably attached to the opposite end of the pull tab support, said pull tab support comprising: a support body including a peripheral wall defining therein an aperture for the pivotal connection to the slider body, a beam lying substantially in the plane defined by the arcuate shape of the peripheral wall and linking confronting ends of the peripheral wall and a hook portion including an upper wall extending from the confronting ends and a lower wall hooked therefrom to define with the upper wall a gap for loosely receiving an annular portion of the pull tab, said upper wall being raised above the level of the peripheral wall to thus define an opening facing the peripheral wall between the proximal end of the upper wall and the beam, the upper wall and the lower wall having in their respective inner surfaces upper engaging means and lower engaging means; and a substantially U-shaped resilient member including an upper leg, a lower leg and an arcuate joint joining the upper and lower legs, the upper leg and the lower leg having at their respective distal ends upper fitting means and lower fitting means; the resilient member having its upper and lower fitting means brought into fitting engagement with the upper and lower engaging means, respectively, of the upper and lower wall, with its upper leg fitted through the opening in and with its arcuate joint snugly embracing the beam, so that the resilient member comes into reliable engagement with the support body to thus close the gap.

2. A slide fastener slider according to claim 1, the lower leg of the resilient member being bent outwardly adjacent to the distal end thereof to provide a slant foot extending obliquely downwardly therefrom.

3. A slide fastener slider according to claim 2, the distance between the bending point of the lower leg and the corresponding point of the upper leg being less than the length of the major axis and the length of the minor axis of the oval cross section of the annular portion of the pull tab.

4. A slide fastener slider according to claim 1, the upper leg being of substantially the same width as the opening.

5. A slide fastener slider according to claim 4, the beam having at an upper side and a lower side an upper furrow and a lower furrow, respectively; the upper furrow communicating to and being substantially of the same width as the opening; and the upper leg and the lower leg being substantially of the same width as the upper furrow and the lower furrow, respectively.

6. A slide fastener slider according to claim 1, the lower leg of the resilient member being provided at its distal end with an upright stopper, the distance between the top of the upright stopper and the distal end of the upper leg being less than the length of the major axis and the length of the minor axis of the oval cross section of the annular portion of the pull tab.

7. A slide fastener slider according to claim 1, the upper and the lower fitting means being an upper and a lower fingers provided at the respective distal ends of the upper and the lower legs of the resilient member; the upper and the lower engaging means being an upper and a lower groove formed in the inner surface of the upper wall and at the distal end of the inner surface of the lower wall, respectively, for fitting engagement with the upper and lower fingers, respectively, of the resilient member.

8. A slide fastener slider according to claim 1, the lower fitting means being a pair of fingers provided at both corners of the lower leg; the lower engaging means being a pair of notches formed at both corners of the inner surface of the lower wall, respectively, for fitting engagement with the fingers, respectively, of the lower leg; the distance between the fingers being slightly greater than the distance between the corner notches.

9. A slide fastener slider according to claim 1, the peripheral wall being arcuate.

* * * * *